US012018668B2

(12) United States Patent
Reinhard et al.

(10) Patent No.: US 12,018,668 B2
(45) Date of Patent: Jun. 25, 2024

(54) DIAPHRAGM PUMP FOR CONVEYING A FLUID

(71) Applicant: ProMinent GmbH, Heidelberg (DE)

(72) Inventors: Martin Reinhard, Heidelberg (DE); Dieter Binz, Hirschberg (DE)

(73) Assignee: PROMINENT GMBH, Heidelberg (DE)

( * ) Notice: Subject to any disclaimer, the term of this patent is extended or adjusted under 35 U.S.C. 154(b) by 85 days.

(21) Appl. No.: 17/691,342

(22) Filed: Mar. 10, 2022

(65) Prior Publication Data

US 2022/0299018 A1 Sep. 22, 2022

(30) Foreign Application Priority Data

Mar. 19, 2021 (DE) ..... 10 2021 106 765.0

(51) Int. Cl.

| | |
|---|---|
| ***F04B 43/02*** | (2006.01) |
| ***F04B 13/00*** | (2006.01) |
| ***F04B 23/02*** | (2006.01) |
| ***F04B 43/06*** | (2006.01) |

(52) U.S. Cl.

CPC ..... *F04B 43/02* (2013.01); *F04B 13/00* (2013.01); *F04B 23/02* (2013.01); *F04B 43/06* (2013.01)

(58) Field of Classification Search

CPC ..... F04B 13/00; F04B 23/02; F04B 43/02; F04B 43/053; F04B 45/0533; F04B 45/0536; F04B 43/06; F04B 43/067; F04B 43/073

See application file for complete search history.

(56) References Cited

U.S. PATENT DOCUMENTS

2014/0147292 A1 5/2014 Fritsch
2015/0004005 A9* 1/2015 Fritsch ..... F04B 43/0081 417/472

FOREIGN PATENT DOCUMENTS

DE 102010039831 A1 3/2012
DE 102014010108 A1 1/2016

* cited by examiner

*Primary Examiner* — Philip E Stimpert
(74) *Attorney, Agent, or Firm* — PAUL & PAUL

(57) ABSTRACT

The present invention relates to a diaphragm pump for conveying a fluid, a method for starting up a diaphragm pump for conveying a fluid and the use of a diaphragm pump for conveying a fluid.

19 Claims, 7 Drawing Sheets a)

b)

a)

b)

a)

b)

DIAPHRAGM PUMP FOR CONVEYING A FLUID

CROSS-REFERENCE TO RELATED APPLICATION

Figure 1:
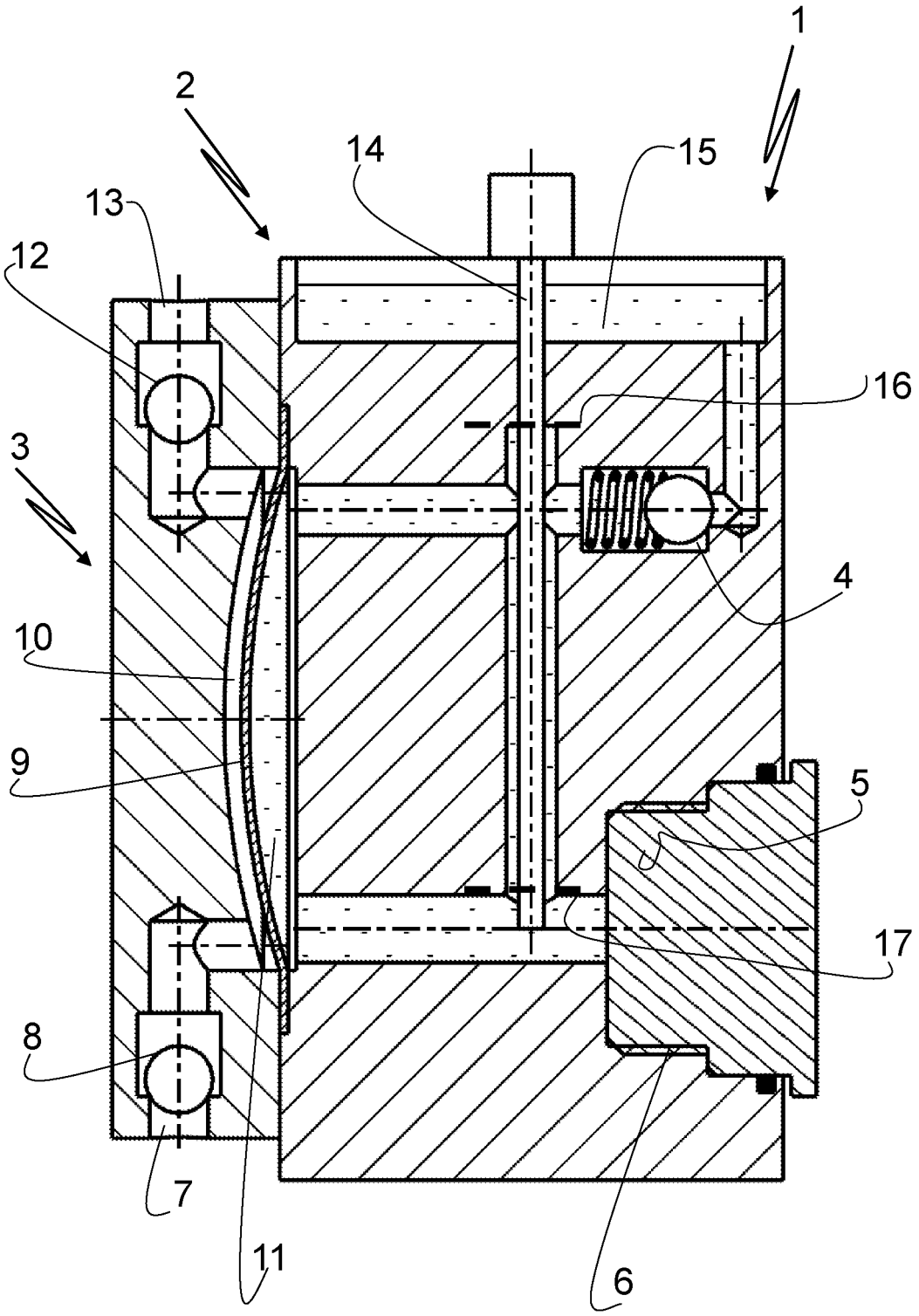

This application claims the priority of German Application No. 10 2021 106 765.0, filed on Mar. 19, 2021.

The present invention relates to a diaphragm pump for conveying a fluid, a method for starting up a diaphragm pump for conveying a fluid, and the use of a diaphragm pump for conveying a fluid.

Hydraulically driven diaphragm pumps are known for conveying fluids. Such diaphragm pumps comprise a metering head and a hydraulic block, which are connected to one another such that a cavity is formed between them. The diaphragm divides the cavity into a hydraulic chamber and a delivery chamber. In operation, the delivery chamber is connected to a suction line via a suction check valve and to a pressure line via a pressure check valve.

In the suction stroke, the diaphragm is moved to a position in which the volume of the delivery chamber is the largest, so that the fluid to be conveyed is drawn from the suction line into the delivery chamber via the suction check valve. In the subsequent pressure stroke, the diaphragm is moved toward the position in which the volume of the delivery chamber is the smallest. This closes the suction check valve, whereupon the pressure in the delivery chamber increases until the pressure check valve opens and the fluid in the delivery chamber is forced into the pressure line.

To drive the diaphragm, the diaphragm pump comprises a displacement element. Said element is in fluid communication with the working fluid-filled hydraulic chamber. The quantity of working fluid in the hydraulic chamber can decrease during operation of the pump, in particular as a result of leaks. The hydraulic chamber is therefore connected to a reservoir filled with working fluid via a leakage compensation valve in order to replenish associated losses.

However, in the event of a malfunction of the diaphragm pump, for example due to a blockage of the suction line, it can happen that too much of the working fluid in the reservoir is added to the hydraulic chamber. Due to the increased quantity of working fluid in the hydraulic chamber, the diaphragm is consequently deflected more strongly in the pressure stroke than is usual in normal operation and can then, in particular if it comes into contact with the inlets of the suction or pressure line, be perforated. In the worst case, this can result in the diaphragm having to be replaced; i.e. the diaphragm pump has to be taken out of service. Such a diaphragm change is laborious, because the diaphragm pump has to be removed from the processing system into which it is integrated.

In light of this, the object of the present invention is to provide a diaphragm pump for conveying a fluid in which there is a lower risk of perforation of the diaphragm.

This object is achieved by a diaphragm pump according to Claim 1.

The diaphragm pump according to the invention comprises a metering head and a hydraulic block, which are connected to one another such that a cavity is formed between them. This cavity is divided by a diaphragm into a hydraulic chamber and a delivery chamber having the volume $V_{FR}$, wherein the hydraulic chamber is filled with a working fluid having the volume $V_{HR,\ A}$ and comprises a movably guided, drivable displacement element.

The displacement element is in fluid communication with the hydraulic chamber, so that a pulsating working fluid pressure can be produced by moving it back and forth. Between and during operation of the diaphragm pump, the displacement element is moved back and forth, preferably exclusively, between two positions of maximum deflection. As a result, a volume $V_{VE}$ of the working fluid is displaced so that the diaphragm is moved back and forth between a pressure position and a suction position by the movement of the displacement element in order to convey the fluid from the suction port to the pressure port. The volume of the delivery chamber $V_{FR}$ in the pressure position $V_{FR,\ min}$ is less than the volume of the delivery chamber in the suction position $V_{FR,\ max}$.

The diaphragm pump further comprises a reservoir which is filled with working fluid having the volume $V_{RE,\ A}$ and is connected to the hydraulic chamber via a leakage compensation valve. If the pressure in the hydraulic chamber in the suction position of the diaphragm is less than a predetermined minimum value $p_{Min}$, the leakage compensation valve opens and working fluid is added from the reservoir to the hydraulic chamber. This ensures that working fluid losses in the hydraulic chamber are compensated during operation of the pump. The displacement element is preferably guided through the reservoir, so that any leakage of working fluid can be returned to the reservoir by the movement of the displacement element.

The diaphragm pump according to the invention is characterised in that the volume of working fluid with which the reservoir is filled ($V_{RE,A}$) is limited in comparison to the hydraulically driven diaphragm pumps known from the prior art, namely corresponds at most to the volume of the delivery chamber in the pressure position $V_{FR,\ min}$. This can reduce the risk of perforation of the diaphragm.

In a preferred embodiment of the invention $V_{RE,A}<4/5*V_{FR,\ min}$, more preferably $V_{RE,A}<3/4*V_{FR,\ min}$, even more preferably $V_{RE,A}<1/2*V_{FR,\ min}$ and most preferably $V_{RE,A}<1/5*V_{FR,\ min}$.

Because of the small volume of working fluid in the reservoir, only a comparatively small volume of working fluid is added to the hydraulic chamber if the diaphragm pump malfunctions, for example if the suction line is blocked. Since the volume of working fluid that can be disposed in the hydraulic chamber is limited, the maximum deflection of the diaphragm is also limited, which reduces the risk of perforations accordingly.

Reducing the working fluid volume in the reservoir moreover additionally favours a compact design of the pump, which is in particular advantageous for metering pumps.

A correspondingly small volume of working fluid in the reservoir is particularly preferably achieved in that the reservoir has a volume of less than $V_{FR,\ min}$.

The volume of working fluid with which the reservoir is filled ($V_{RE,A}$) is preferably less than the volume displaced by the displacement element during a movement between the maximum positions ($V_{VE}$). It is particularly preferably many times smaller than $V_{VE}$. In certain embodiments, this can reduce the risk of perforation of the diaphragm even more.

In a preferred embodiment of the invention $V_{RE,A}<1/2*V_{VE}$, more preferably $V_{RE,A}<1/3*V_{VE,\ min}$, even more preferably $V_{RE,A}<1/5*V_{VE}$ and most preferably $V_{RE,A}<1/10*V_{VE}$.

The diaphragm pump preferably comprises an auxiliary chamber which is or can be connected to the hydraulic chamber, via which the volume of the hydraulic chamber can be expanded by a volume $V_z$.

In an operating position, i.e. a spatial arrangement of the diaphragm pump that enables long-term operation of the pump, the auxiliary chamber is disposed, preferably entirely, geodetically lower than the hydraulic chamber.

The volume $V_z$ of the auxiliary chamber is preferably greater than or equal to $V_{RE,A}+V_{HR,\ A}$. This allows the working fluid with which the reservoir and the hydraulic chamber are filled to be fully received by the auxiliary chamber, which, for example, allows the diaphragm to be changed without draining the working fluid.

In this context, it is particularly advantageous that the auxiliary chamber can have a comparatively small volume, because the diaphragm pumps according to the invention only comprise a small amount of working fluid in the reservoir. This ensures a compact design of the diaphragm pumps despite the auxiliary chamber.

In a preferred embodiment of the invention, the volume of the auxiliary chamber can be changed. Consequently, if the auxiliary chamber is connected to the hydraulic chamber, the volume of the hydraulic chamber can be expanded by a variable volume. The maximum volume by which the volume of the hydraulic chamber can be expanded is $V_{z,max}$.

The volume of such an auxiliary chamber can preferably be changed via a movable element disposed inside the auxiliary chamber. The volume $V_z$, by which the hydraulic chamber can be expanded by the connected or connectable auxiliary chamber, can thus be changed between a minimum volume $V_{Z,\ min}$ and a maximum volume $V_{z,max}$. With the aid of the movable element, the variable volume can particularly preferably be reduced to 0, i.e. $V_{Z,\ min}=0$.

The volume $V_{z,max}$ of an auxiliary chamber having a variable volume is preferably greater than or equal to $V_{RE,A}+V_{HR,\ A}$, so that the working fluid with which the reservoir and the hydraulic chamber are filled can be fully received by the auxiliary chamber. The working fluid can be conveyed back into the hydraulic chamber by subsequently reducing the volume to $V_{Z,\ min}$. This allows the diaphragm to be changed without draining the hydraulic fluid. The total volume $V_{z,max}$ in the above-described operating position is particularly preferably geodetically lower than the hydraulic chamber.

The auxiliary chamber particularly preferably comprises a volume subsection $V_{z,T}$, which is greater than or equal to $V_{RE,A}+V_{HR,A}$ and, in the above-described operating position, is geodetically lower than the hydraulic chamber. This allows all of the working fluid with which the reservoir and the hydraulic chamber are filled to enter the auxiliary chamber purely by gravity. $V_{z,max}=V_{z,T}$ is particularly preferred.

In a preferred embodiment of the invention, in an operating position of the diaphragm pump, the reservoir is disposed, preferably entirely, geodetically higher than the hydraulic chamber. This allows the working fluid to enter the hydraulic chamber via the leakage compensation valve by gravity alone.

In a preferred embodiment of the invention, the metering head and the hydraulic block of the diaphragm pump are releasably connected to one another, for example by fastening means such as screws.

The hydraulic block and/or the metering head are preferably disposed on or at a base element, wherein the hydraulic block and/or the metering head and/or the base element comprise a positive guide, so that the hydraulic block and/or the metering head can be moved relative to a base plate by means of the positive guide, wherein the hydraulic block is preferably movable relative to the base plate. The positive guide is configured such that the hydraulic block and the metering head can be moved relative to one another only along a path specified by the positive guide. The positive guide allows the diaphragm to be accessed without the risk of damaging the diaphragm when releasing the hydraulic block from the metering head (or vice versa). Either the hydraulic block or the metering head can be moved relative to the base plate by means of the positive guide. Preferably, the hydraulic block can be moved relative to the base plate, as this can avoid having to disassemble the metering head from the suction and the pressure line.

The positive guide is preferably formed by a groove and a sliding block guided therein, wherein the base plate comprises either the groove or the sliding block and the hydraulic block or the metering head or the base element comprises the corresponding counterpart, i.e. the sliding block or the groove.

The hydraulic block and the metering head particularly preferably comprise flat contact surfaces, which lie one on top of the other during operation of the diaphragm pump. If the contact surfaces are flat, the groove of a possibly existing positive guide in a preferred embodiment is at least partly, preferably entirely, parallel to said flat contact surfaces.

Since the supply of working fluid in the reservoir with horizontally acting displacers cannot be reduced at will for technical reasons, in a preferred embodiment of the invention, the movement of the displacement element in the operating position does not take place in horizontal direction.

The displacement element is preferably a vertical displacement element; i.e. in the operating position, the movement of the displacement element between the two positions of maximum deflection takes place in vertical direction.

The invention also relates to a method for starting up a diaphragm pump for conveying a fluid comprising a) a metering head and a hydraulic block, which are connected to one another such that a cavity is formed between them, b) a diaphragm, which divides the cavity into a hydraulic chamber and a delivery chamber having the volume $V_{FR}$, wherein the hydraulic chamber i) is filled with a working fluid having the volume $V_{HR,\ A}$ and ii) comprises a movably guided, drivable displacement element, which is in fluid communication with the hydraulic chamber and can be moved back and forth between two positions of maximum deflection during operation of the diaphragm pump, wherein a volume $V_{VE}$ of the working fluid is displaced between the positions of maximum deflection so that the diaphragm can be moved back and forth between a pressure position and a suction position by the movement of the displacement element, wherein the volume of the delivery chamber in the pressure position $V_{FR,\ min}$ is less than the volume of the delivery chamber $V_{FR}$ in the suction position $V_{FR,\ max}$ in order to convey the fluid from the suction port into the pressure port, c) a reservoir, which i) can be filled with working fluid, and ii) is connected to the hydraulic chamber via a leakage compensation valve such that, when the pressure in the hydraulic chamber in the suction position of the diaphragm is less than a predetermined minimum value $p_{Min}$, the leakage compensation valve opens and working fluid from the reservoir is added to the hydraulic chamber, wherein the method comprises the following step:

filling the reservoir with working fluid having the volume $V_{RE,\ A}$, wherein $V_{RE,A}$ $V_{FR,\ min}$.

In a preferred embodiment of the invention $V_{RE,A}<4/5*V_{FR,\ min}$, more preferably $V_{RE,A}<3/4*V_{FR,\ min}$, even more preferably $V_{RE,A}<1/2*V_{FR,\ min}$ and most preferably $V_{RE,A}<1/5*V_{FR,\ min}$.

The volume of working fluid with which the reservoir is filled is preferably less than $V_{VE}$, more preferably less than $1/2*V_{VE}$, even more preferably less than $1/3*V_{VE}$, even much more preferably less than $1/5*V_{VE}$ and most preferably less than $1/10*V_{VE}$.

The invention also relates to the use of a diaphragm pump according to Claims 1-10 for conveying a fluid.

Figure 2A:
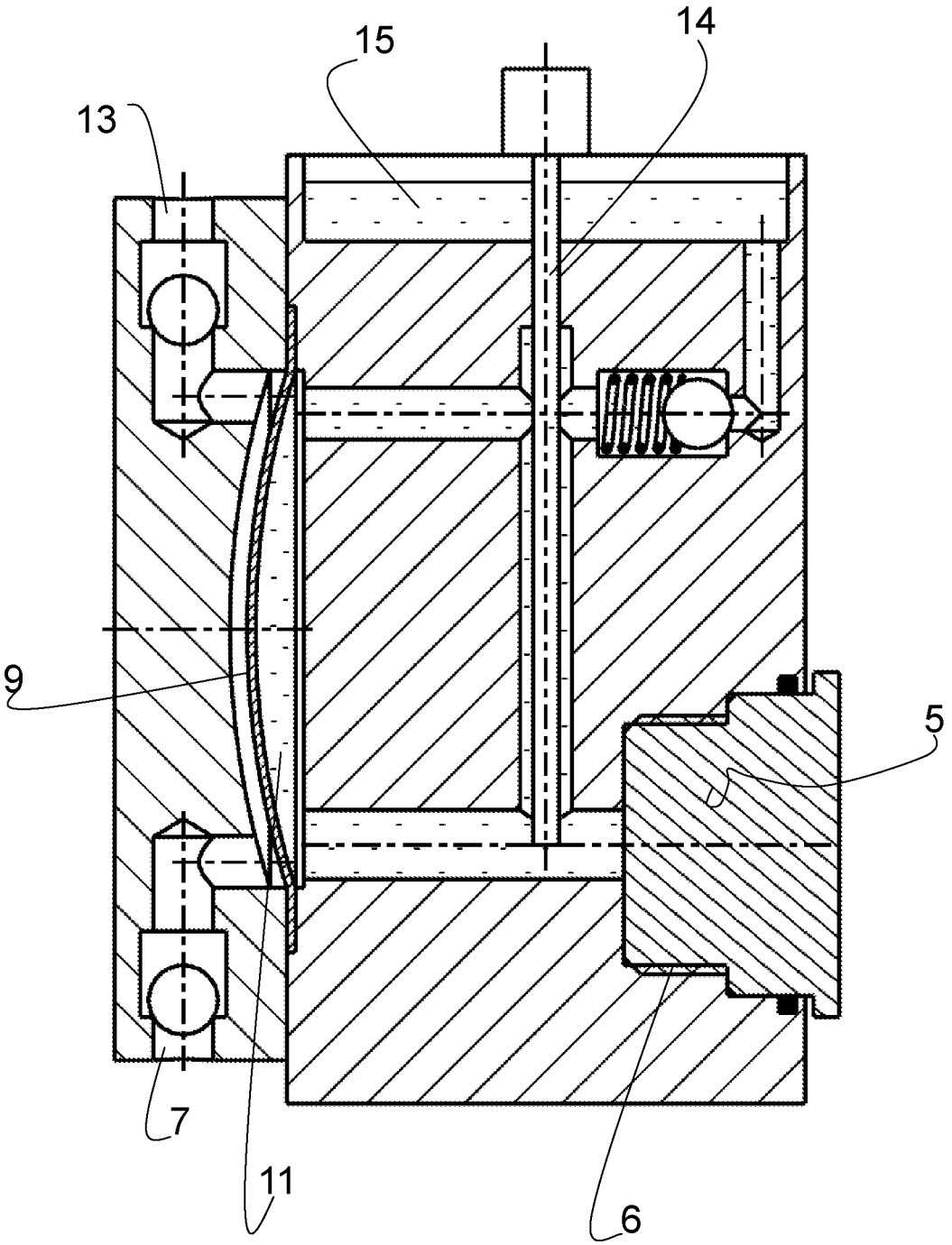
Figure 2B:
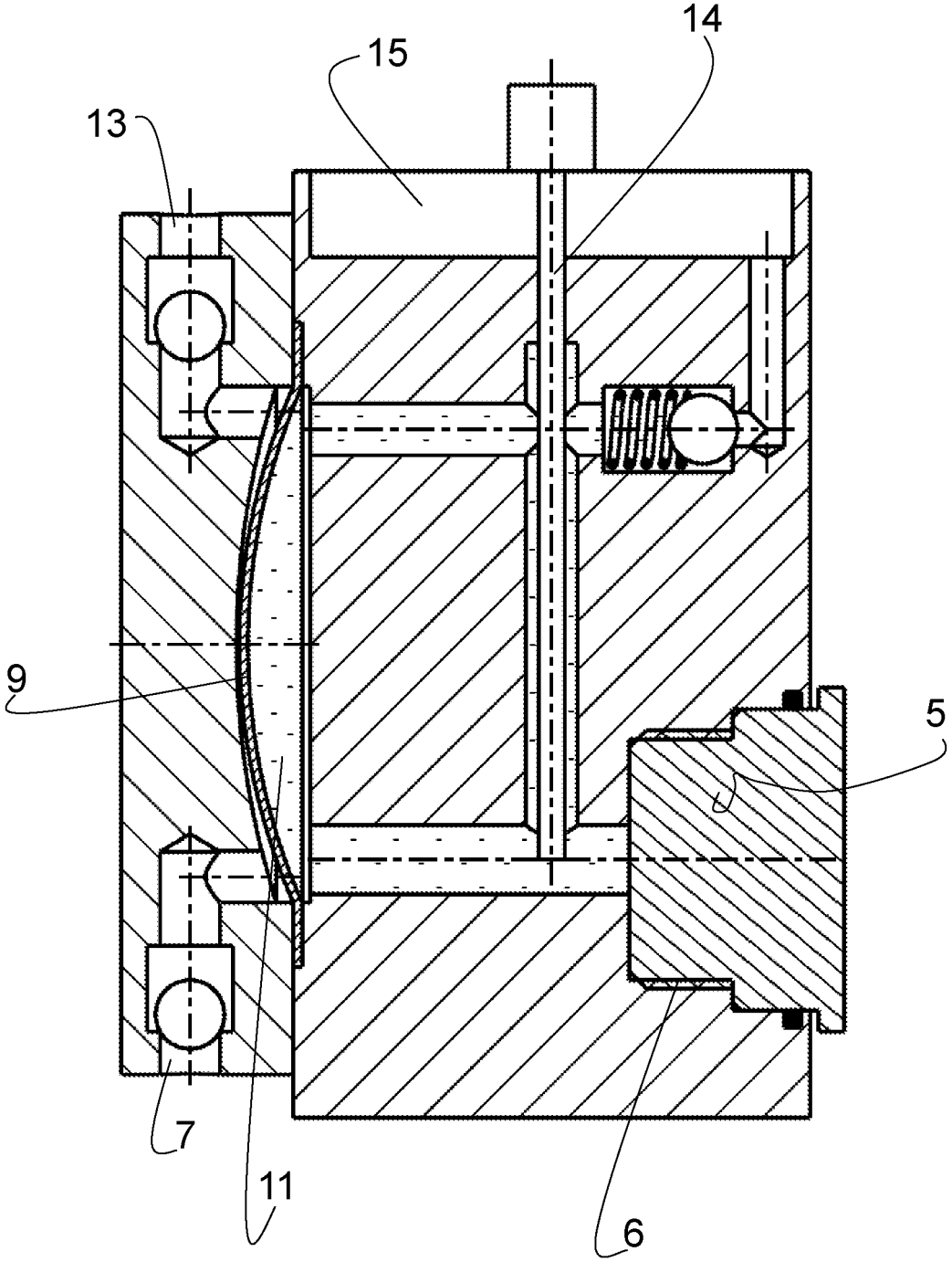
Figure 3A:
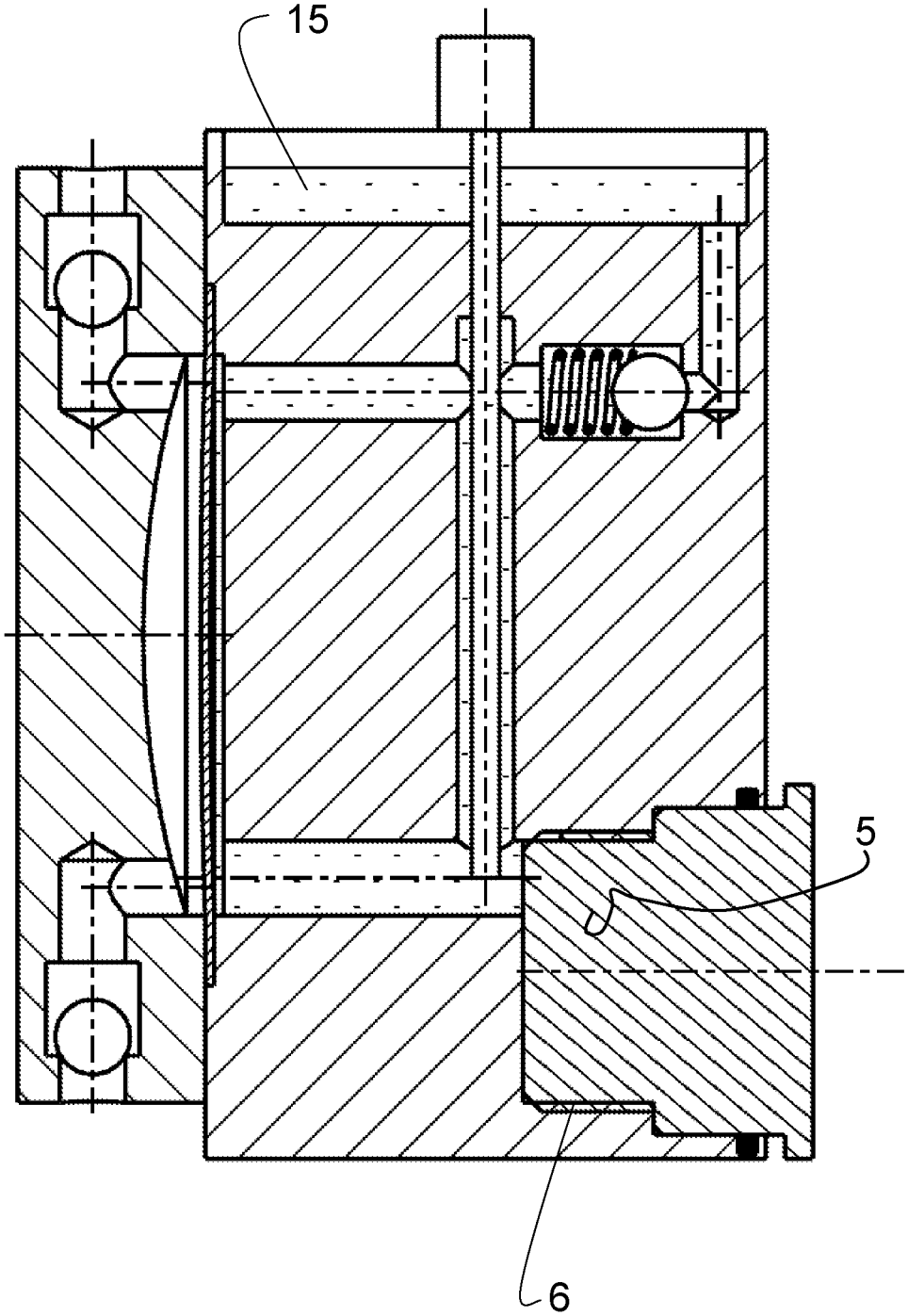
Figure 3B:
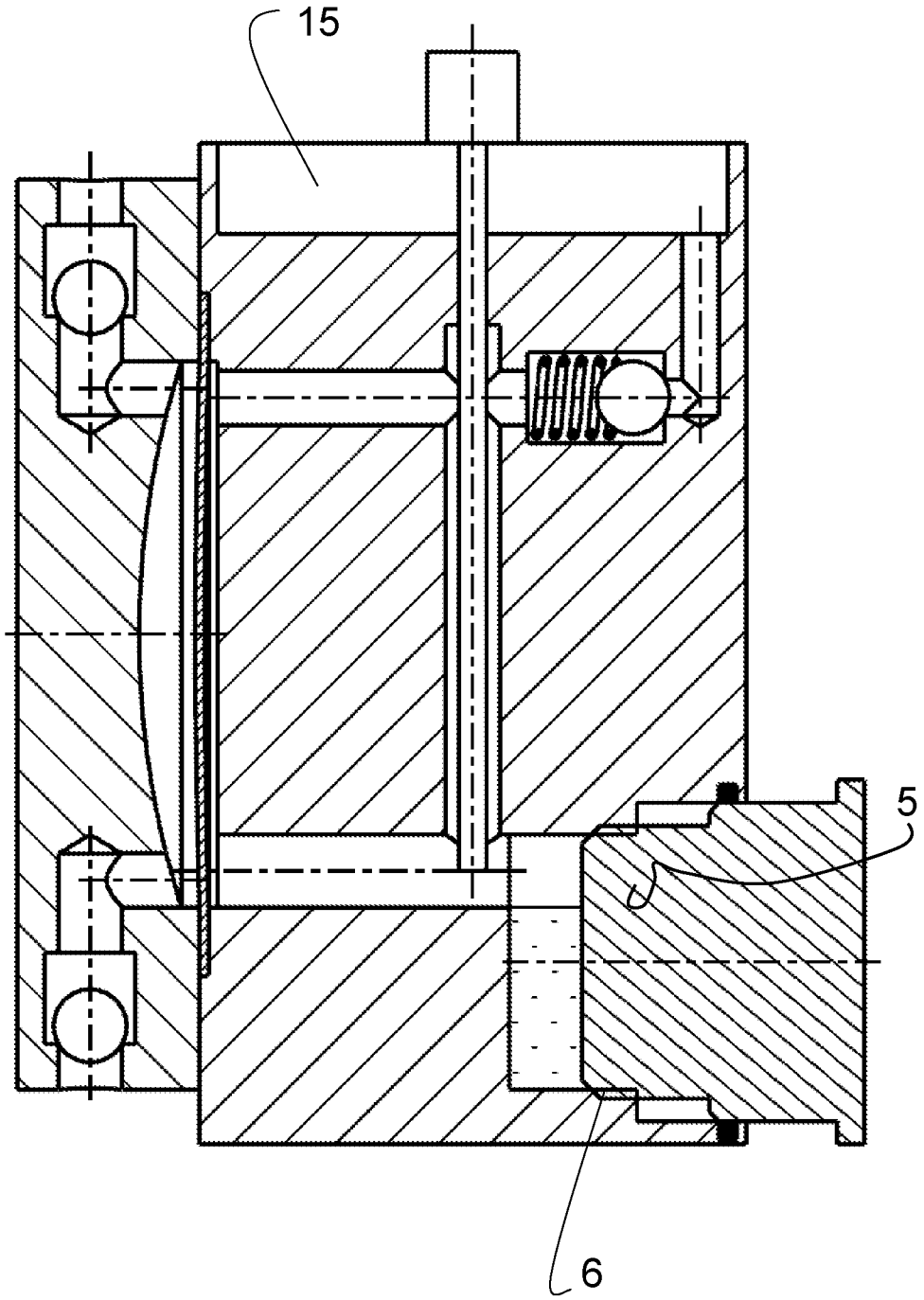
Figure 4A:
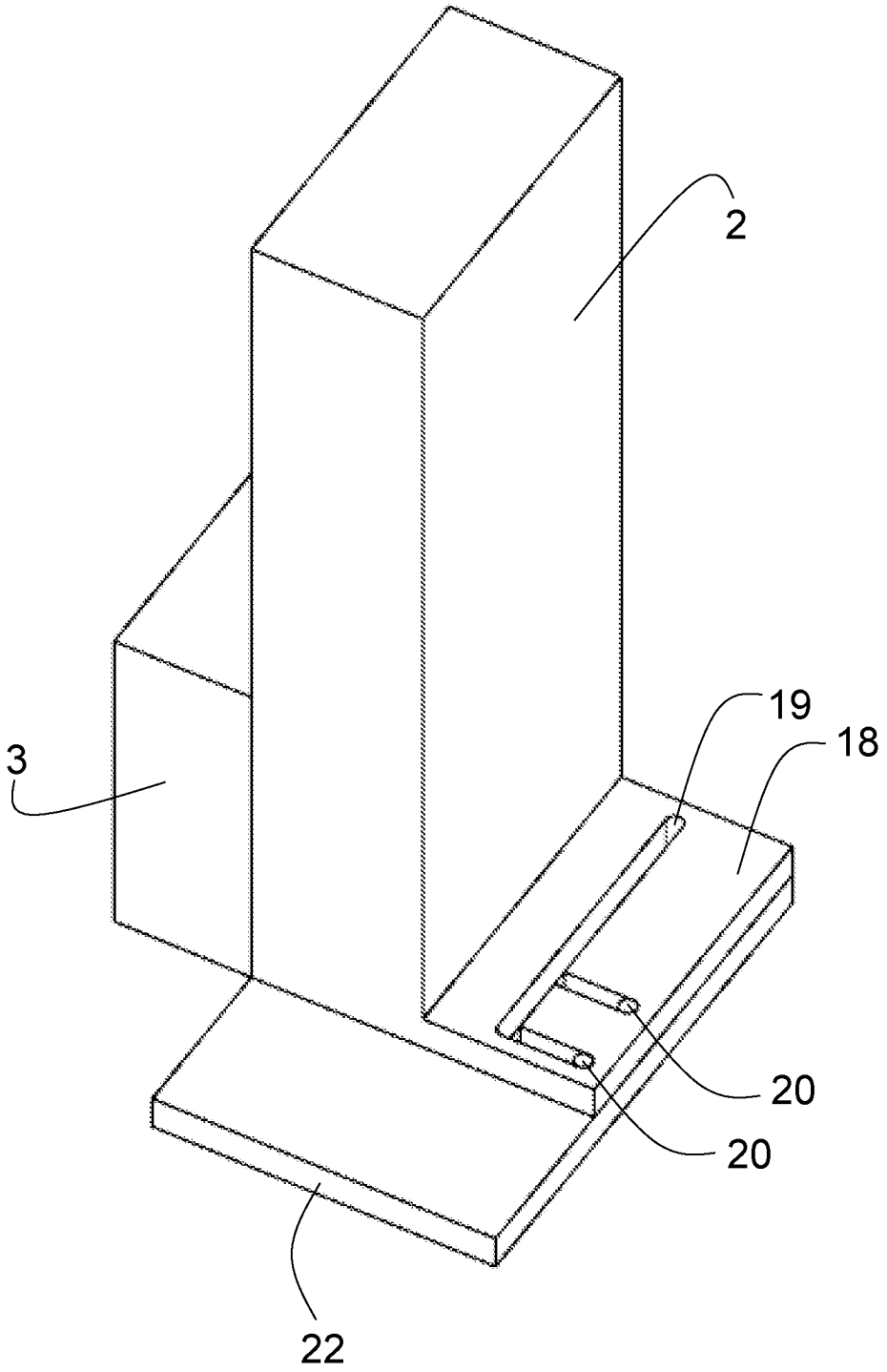
Figure 4B:
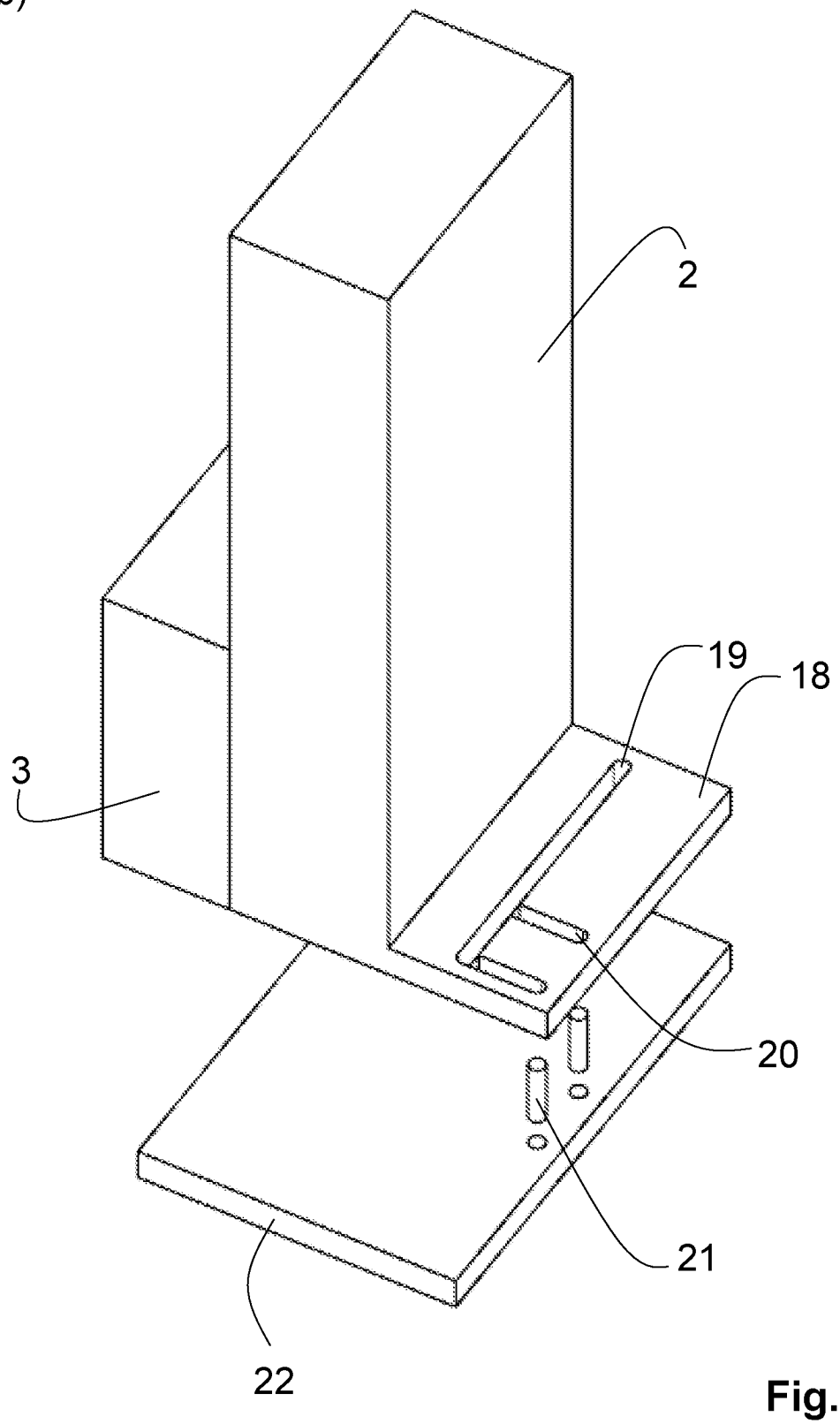

Further advantages, features and possible applications will become apparent from the following description of preferred embodiments and the associated figures. The figures show:

FIG. 1 an embodiment of the diaphragm pump according to the invention,

FIG. 2 a juxtaposition of the diaphragm pump according to the invention at the end of the pressure stroke in normal operation, i.e. unblocked suction and pressure line (FIG. 2 *a*), and in the event of a blockage of the suction line (FIG. 2 *b*), FIG. 3 a diaphragm pump according to the invention with an auxiliary chamber having a variable volume at a volume $V_z=0$ (FIG. 3 *a*) and a volume $V_z>V_{RE,A}+V_{HR,A}$ (FIG. 3*b*) and FIG. 4*a* shows a diaphragm pump according to the invention, which is disposed on a base element and comprises a positive guide, the diaphragm pump also being shown in an exploded view in FIG. 4*b*.

The embodiment of the diaphragm pump 1 according to the invention shown in FIG. 1 comprises a metering head 3 and a hydraulic block 2, which are connected to one another such that a cavity is formed between them. The diaphragm 9 divides the cavity into a hydraulic chamber 11 and a delivery chamber 10 having the volume $V_{FR}$. The hydraulic chamber 11 is filled with working fluid and comprises a displacement element 14 that can be moved back and forth in vertical direction between a position of minimal deflection 16 and a position of maximum deflection 17 in order to displace a volume $V_{Ve}$ of the working fluid. The hydraulic block 2 further comprises a leakage compensation valve 4, via which, when the pressure in the hydraulic chamber 11 in the suction position of the diaphragm 9 is less than a predetermined minimum value $p_{Min}$, working fluid from the reservoir 15 can be added to the hydraulic chamber 11. The hydraulic block 2 further comprises an auxiliary chamber 6, the volume of which can be changed by moving the element 5 within the auxiliary chamber 6. By moving the displacement element 14 back and forth during operation of the diaphragm pump 1, the diaphragm 9 is moved back and forth between a pressure position and a suction position, and the volume of the delivery chamber 10 is thus changed to thereby convey fluid from the suction line 7 into the pressure guide 13.

FIG. 2 shows a juxtaposition of the diaphragm pump 1 according to the invention at the end of the pressure stroke in normal operation, i.e. unblocked suction and pressure line 7, 13 (FIG. 2 *a*), and in the event of a blockage of the suction line 7 (FIG. 2 *b*), At the end of the pressure stroke, the displacement element 14 is in the position of maximum deflection 17, as a result of which the diaphragm 9 is maximally deflected by the working fluid disposed in the hydraulic chamber 11. If the entire volume of working fluid of the reservoir 15 has already been added to the hydraulic chamber 11 due to a malfunction of the diaphragm pump 1, e.g. due a blockage of the suction line 7, there is an increased amount of working fluid in the hydraulic chamber 11, as shown in FIG. 2 *b*). As a result, the diaphragm 9 is deflected more strongly in the direction of the metering head 3 than is the case in normal operation, i.e. if no or only a small amount of working fluid has been added (see FIG. 2*a*). Since the volume of working fluid with which the reservoir 15 is filled is limited in the diaphragm pump 1 according to the invention to the volume of the delivery chamber 10 in the pressure position $V_{FR,\ min}$, the maximum diaphragm deflection is limited as well. Perforations that can occur in particular due to the diaphragm 9 coming into contact with the edges of the inlets and outlets of the pressure or suction line 7 are thus averted.

FIGS. 3 *a*) and *b*) show a juxtaposition of a diaphragm pump 1 according to the invention with a variable volume of the auxiliary chamber 6 at different volumes of the auxiliary chamber 6. The volume of the auxiliary chamber 6 can be changed via the movable element 5. FIG. 3 *a*) shows the auxiliary chamber 6 at volume $V_z=0$, i.e. when the movable element 5 fills the volume of the auxiliary chamber 6 completely. FIG. 3 *b*), on the other hand, shows the auxiliary chamber 6 at a volume $V_z>V_{RE,A}+V_{HR,A}$. This means that the auxiliary chamber 6 here is able to hold all of the working fluid from the reservoir 15 and the hydraulic chamber 11. Since at least one volume $V_{z,T}>V_{RE,A}+V_{HR,A}$ of the auxiliary chamber 6 is geodetically lower than the hydraulic chamber 11, all of the working fluid can flow into the auxiliary chamber 6 with the aid of gravity. The metering head 3 and the hydraulic block 2 can then be separated from one another, for example in order to change the diaphragm 9. The auxiliary chamber 6 can subsequently be filled again by moving the element 5, i.e. the volume of the auxiliary chamber 6 can be reduced, and the working fluid can thus be conveyed back into the hydraulic chamber 11. As a result, the diaphragm can be changed without draining the working fluid.

FIGS. 4 *a*) and *b*) show a diaphragm pump 1 according to the invention, which is disposed on a base element 18 comprising a positive guide. The illustration shows an arrangement in which the base element 18, here in the form of a plate, is disposed laterally on the hydraulic block 2. The figure shows the guide groove, which comprises sections that extend parallel 19 and orthogonal 20 to the contact surfaces of the hydraulic block 2 and the metering head 3. Sliding blocks 21 disposed on a base plate 22 engage in these guide grooves. Therefore, after dismantling the fastening means that connect the metering head 3 and the hydraulic block 2 during operation of the diaphragm pump 1, the hydraulic block 2 can be displaced laterally against the metering head 3 held by the piping in order to thus make the diaphragm 9 easily accessible. The positive guide prevents damage to the diaphragm 9 during the release process, so that the diaphragm 9 can be changed safely and easily without dismantling the piping on the metering head 3.

LIST OF REFERENCE SYMBOLS

1 Diaphragm Pump
2 Hydraulic Block
3 Metering head
4 Leakage compensation valve
5 Movable element of the auxiliary chamber
6 Auxiliary chamber
7 Suction line
8 Suction-side check valve
9 Diaphragm
10 Delivery chamber

11 Hydraulic chamber
12 Pressure-side check valve
13 Pressure line
14 Displacement element
15 Reservoir with working fluid
16 Position of minimum deflection of the displacement element
17 Position of maximum deflection of the displacement element
18 Base element
19 1st guide groove section
20 2nd guide groove section
21 Sliding block
22 Base plate

The invention claimed is:

1. A diaphragm pump (1) for conveying a fluid comprising a) a metering head (3) and a hydraulic block (2), which are connected to one another such that a cavity is formed between them, b) a diaphragm (9), which divides the cavity into a hydraulic chamber (11) and a delivery chamber (10) having the volume $VF_{R,}$ wherein the hydraulic chamber i) is filled by a working fluid having the volume $V_{HR,A}$, and ii) comprises a movably guided, drivable displacement element (14), which is in fluid communication with the hydraulic chamber (11) and can be moved back and forth between two positions of maximum deflection (16, 17) during operation of the diaphragm pump (1), wherein a volume $V_{VE}$ of the working fluid is displaced between the positions of maximum deflection so that the diaphragm (9) can be moved back and forth between a pressure position and a suction position by the movement of the displacement element (14), wherein the volume of the delivery chamber (10) in the pressure position $V_{FR,\ min}$ is less than the volume of the delivery chamber (10) in the suction position $VF_{FR,\ max}$ in order to convey the fluid from the suction port into the pressure port c) a reservoir, which i) comprises a working fluid having the volume $V_{RE,A}$ completely filling the reservoir and ii) is connected to the hydraulic chamber (11) via a leakage compensation valve (4) such that, when the pressure in the hydraulic chamber (11) in the suction position of the diaphragm (9) is less than a predetermined minimum value $p_{min}$, the leakage compensation valve (4) opens and working fluid from the reservoir (15) is added to the hydraulic chamber (11), characterised in that $0<V_{RE,A}\leq V_{FR,\ min}$.

2. The diaphragm pump according to claim 1, wherein $V_{RE,A}<4/5*V_{FR,\ min}$.

3. The diaphragm pump according to claim 2 wherein $V_{RE,A}<3/4*V_{FR,\ min}$.

4. The diaphragm pump according to claim 1, wherein $V_{RE,A}\leq V_{VE}$.

5. The diaphragm pump according to claim 4 wherein $V_{RE,A}\leq 1/5*V_{VE}$.

6. The diaphragm pump according to claim 1 wherein the diaphragm pump comprises an auxiliary chamber (6) which is or can be connected to the hydraulic chamber and via which the volume of the hydraulic chamber (11) can be expanded by a volume Vz.

7. The diaphragm pump according to claim 6 wherein in an operating position of the diaphragm pump (1) the auxiliary chamber (6) is disposed geodetically lower than the hydraulic chamber (11).

8. The diaphragm pump according to claim 6, wherein the volume of the auxiliary chamber (6) can be changed.

9. The diaphragm pump according to claim 8 wherein a) the maximum volume by which the hydraulic chamber (11) can be expanded is $V_{z,\ max}$ and b) $Vz_{,\ max}\geq V_{RE,A}+V_{HR,A}$.

10. The diaphragm pump according to claim 8, wherein a movable element (5) is disposed inside the auxiliary chamber (6), via which the volume $V_z$ of the auxiliary chamber (6) can be changed so that the volume $V_z$ by which the hydraulic chamber (11) can be expanded by the connected auxiliary chamber (6) can be changed between a minimum volume $V_{Z,\ min}$ and $V_{z,max}$.

11. The diaphragm pump according to claim 10 wherein $V_{Z,min}=0$.

12. The diaphragm pump according to claim 1, wherein in an operating position of the diaphragm pump the reservoir (15) is disposed geodetically higher than the hydraulic chamber (11).

13. The diaphragm pump according to claim 1, wherein the movably guided and drivable displacement element can be guided through the reservoir.

14. The diaphragm pump according to claim 1, wherein the metering head (3) and the hydraulic block (2) are releasably connected to one another, wherein the hydraulic block and/or the metering head are preferably disposed on or at a base element (18), wherein the hydraulic block and/or the metering head and/or the base element (18) comprise a positive guide (19, 20) so that the hydraulic block and/or the metering head can be moved relative to a base plate (22) by means of the positive guide, wherein the hydraulic block is preferably movable relative to the base plate (22).

15. The diaphragm pump according to claim 14, wherein the positive guide is formed by a groove (19, 20) and a sliding block (21) guided therein, wherein the base plate (22) comprises either the groove or the sliding block and the hydraulic block or the metering head or the base element comprises either the sliding block or the groove.

16. The diaphragm pump according to claim 14, wherein the hydraulic block and the metering head each comprise contact surfaces which lie one on top of the other during operation of the diaphragm pump, wherein the contact surfaces are flat and the groove is at least partly parallel to said flat contact surfaces.

17. The diaphragm pump according to claim 1, wherein the movement of the displacement element (14) in the operating position does not take place in a horizontal direction.

18. Method for starting up a diaphragm pump (1) for conveying a fluid comprising a) a metering head (3) and a hydraulic block (2), which are connected to one another such that a cavity is formed between them, b) a diaphragm (9), which divides the cavity into a hydraulic chamber (11) and a delivery chamber (10) having the volume $V_{FR}$, wherein the hydraulic chamber (11)

i) is filled by a working fluid having the volume $V_{HR,A}$, and ii) comprises a movably guided, drivable displacement element (14), which is in fluid communication with the hydraulic chamber and can be moved back and forth between two positions of maximum deflection (16, 17) during operation of the diaphragm pump, wherein a volume $V_{VE}$ of the working fluid is displaced between the positions of maximum deflection so that the diaphragm (9) can be moved back and forth between a pressure position and a suction position by the movement of the displacement element (14), wherein the volume of the delivery chamber in the pressure position $VF_{FR,\ min}$ is less than the volume of the delivery chamber in the suction position $VF_{FR,\ max}$ in order to convey the fluid from the suction port into the pressure port, c) a reservoir, which i) can be filled with working fluid, and ii) is connected to the hydraulic chamber (11) via a leakage compensation valve (4) such that, when the pressure in the hydraulic chamber in the suction position of the diaphragm is less than a predetermined minimum value $p_{min}$, the leakage compensation valve opens and working fluid from the reservoir is added to the hydraulic chamber, characterised in that it comprises the following step:

completely filling the reservoir with working fluid having the volume $V_{RE,\ A}$, wherein $V_{RE,A} \geq V_{FR,min}$.

19. A method of pumping using a diaphragm pump (1) for conveying a fluid comprising a) a metering head (3) and a hydraulic block (2), which are connected to one another such that a cavity is formed between them, b) a diaphragm (9), which divides the cavity into a hydraulic chamber (11) and a delivery chamber (10) having the volume $V_{FR}$, wherein the hydraulic chamber (11)

i) is filled by a working fluid having the volume $VH_{HR,A}$, and ii) comprises a movably guided, drivable displacement element (14), which is in fluid communication with the hydraulic chamber and can be moved back and forth between two positions of maximum deflection (16, 17) during operation of the diaphragm pump, wherein a volume $V_{VE}$ of the working fluid is displaced between the positions of maximum deflection so that the diaphragm (9) can be moved back and forth between a pressure position and a suction position by the movement of the displacement element (14), wherein the volume of the delivery chamber (10) in the pressure position $V_{FR,\ min}$ is less than the volume of the delivery chamber in the suction position $VF_{FR,\ max}$ in order to convey the fluid from the suction port into the pressure port, c) a reservoir (15), which i) comprises a working fluid having the volume $V_{RE,A}$ completely filling the reservoir, and ii) is connected to the hydraulic chamber via a leakage compensation valve (4) such that, when the pressure in the hydraulic chamber in the suction position of the diaphragm is less than a predetermined minimum value $p_{Min}$, the leakage compensation valve (4) opens and working fluid from the reservoir (15) is added to the hydraulic chamber, characterised in that the volume $V_{RE,\ A}$ is selected such that $0 < V_{RE,A} \geq V_{FR,\ min}$.

* * * * *